US006474086B1

(12) United States Patent
Liu

(10) Patent No.: US 6,474,086 B1
(45) Date of Patent: Nov. 5, 2002

(54) AIR CONDITIONER HAVING FUNCTIONS OF FIRE PREVENTING, SMOKE EXHAUSTING AND WATER SPRAYING

(76) Inventor: Wen-Jie Liu, P.O. Box 90, Tainan City (TW)

( * ) Notice: Subject to any disclaimer, the term of this patent is extended or adjusted under 35 U.S.C. 154(b) by 0 days.

(21) Appl. No.: 10/033,790

(22) Filed: Jan. 3, 2002

(51) Int. Cl.[7] ..... F25B 39/04

(52) U.S. Cl. ..... 62/183; 62/506; 62/507; 169/23; 169/46; 169/60; 454/342

(58) Field of Search ..... 62/183, 506, 507; 236/49.2; 169/23, 42, 45, 46, 56, 57, 58, 60, 89; 239/69, 70, 72, 533.1; 454/342

(56) References Cited

U.S. PATENT DOCUMENTS 1,831,193 A * 11/1931 Quitschalle ..... 169/56
3,772,499 A * 11/1973 Fritzsche ..... 169/56
5,099,652 A * 3/1992 Iida et al. ..... 62/129
5,332,151 A * 7/1994 Kwak ..... 236/49.3
5,979,565 A * 11/1999 Wicks et al. ..... 169/17
6,241,024 B1 * 6/2001 Haase, III ..... 137/357
6,398,118 B1 * 6/2002 Rosen et al. ..... 165/248

* cited by examiner

*Primary Examiner*—William E. Tapolcai
*Assistant Examiner*—Mohammad M. Ali

(57) ABSTRACT

An air conditioner having functions of fire preventing, smoke exhausting and water spraying includes a sensor for sensing smoke or temperature so as to control operation of a wind-releasing gate, a smoke-exhausting gate, a water-spraying nozzle, and an alarm. When the sensor senses dense smoke or high temperature, smoke is quickly sucked through a wind inlet in an air conditioning box, the smoke-exhausting gate and out of a smoke outlet. At the same time, the water-spraying nozzle is started to spray water and the alarm to give out warning sound, elevating public safety.

2 Claims, 2 Drawing Sheets

AIR CONDITIONER HAVING FUNCTIONS OF FIRE PREVENTING, SMOKE EXHAUSTING AND WATER SPRAYING

BACKGROUND OF THE INVENTION

1. Field of the Invention

This invention relates to an air conditioner having functions of fire preventing, smoke exhausting and water spraying, particularly to one using a common air conditioner additionally provided with a sensor, which can sense alterations of indoor vapor or temperature so as to control a wind-releasing gate, a smoke-exhausting gate, a water-spraying nozzle and an alarm, obtaining functions of air conditioning, fire preventing, smoking exhausting and water spraying, and accordingly elevating public safety.

2. Description of the Prior Art

As commonly known, high buildings have been increasingly built year by year, and air conditioners have become absolutely necessary to be installed in a high building. And it is prescribed by the fire-preventing law that smoke-exhausting devices must be provided for high buildings. In general, the smoke-exhausting device, the air conditioning and the water-spraying device of a building are equipped at the same time, but function independently, not related to one another at all.

Besides, an air conditioner nowadays is only provided with a water inlet, a water outlet, an air conditioning box, a wind inlet and a wind outlet, with the air conditioning box provided with a condenser, a motor and a fan. Thus, icy water gets to the condenser through the water inlet and then gets out of the water outlet, and at the same time the fan is driven by the motor to draw in wind through the wind inlet and then the wind gets out of the wind outlet through the condenser, achieving effect of air conditioning.

As can be noted, the conventional way of air conditioning has no functions of smoke exhausting or water spraying, so in case a fire should happen indoors, one can simply use the smoke-exhausting device alone to remove the smoke out of the room and give out alarm signals, or use the water-spraying device alone for spraying water to put out the fire. Under such condition, an air conditioner, a smoke-exhausting device and a water-spraying device have to be installed respectively in a room, not only costing lots of money and taking too much space in a room, but failing to operate synchronously with quickness in case of a fire and increasing trouble in maintenance.

SUMMARY OF THE INVENTION

The objective of this invention is offer an air conditioner having functions of smoke exhausting, water spraying and giving out alarm signals at the same time.

One feature of the invention is that an air conditioning box is provided with a motor at one inner side, with a fan connected with the motor, and a condenser fixed at another inner side. A wind inlet is connected to the condenser of the air conditioning box, and a wind outlet connected to the fan of the air conditioning box, having a wind-releasing gate. Then, a smoke outlet is connected to the fan of the air conditioning box and provided with a smoke exhausting gate, a water inlet is connected to the condenser of the air conditioning box and provided with a water-stopping valve, a backpressure valve and a pressure gauge, and further a water outlet is connected to the condenser of the air conditioning box, having a water exhausting valve and a water-stopping valve. Furthermore, a water-spraying nozzle is positioned between the backpressure valve and the pressure gauge of the water inlet, and connected to the water-stopping valve as well as to the backpressure valve. An alarm is installed between the water spraying nozzle and the water-stopping valve, and connected to the pressure gauge and a pressure switch.

Another feature of the invention is that a power terminal is connected to three no-fuse switches connected orderly to three normally-open contacts and two motor overload protective circuits and a motor. Then, Between the no-fuse switches and the normally-open contacts is connected a fuse connected to a motor overload protective switch, which connected in parallel to a yellow light, a timing contact, a plurality of normally-closed contacts and normally-open contacts, a motor switch and a transforming and rectifying circuit.

One normally-closed contact is connected in series to another normally-closed contact and a motor switch, and the motor has one end connected in parallel to a normally-opened contact and the motor switch. Then, the normally-open contact and the motor switch have their other end connected to one end of the timing contact, a magnet control switch and a red light. The magnet control switch has one end connected to the motor overload protective contact connected to one end of the yellow light. Then, one normally-closed contact is connected in series to another normally-closed contact having one end connected in parallel to a wind-releasing gate and a smoke-exhausting gate. Besides, the normally-open contact and the motor switch are connected in parallel to the wind-releasing gate, the smoke-exhausting gate, a timer, an alarm and a relay. Between the no-fuse switch and the normally-open contact are connected the motor overload protective contact, the red light, the wind-releasing gate, the smoke-exhausting gate, the timer, the alarm device, one end of the relay and a transforming and rectifying circuit, thus making up a circuit. Additionally, the transforming and rectifying circuit has one end connected to another relay and a sensor.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
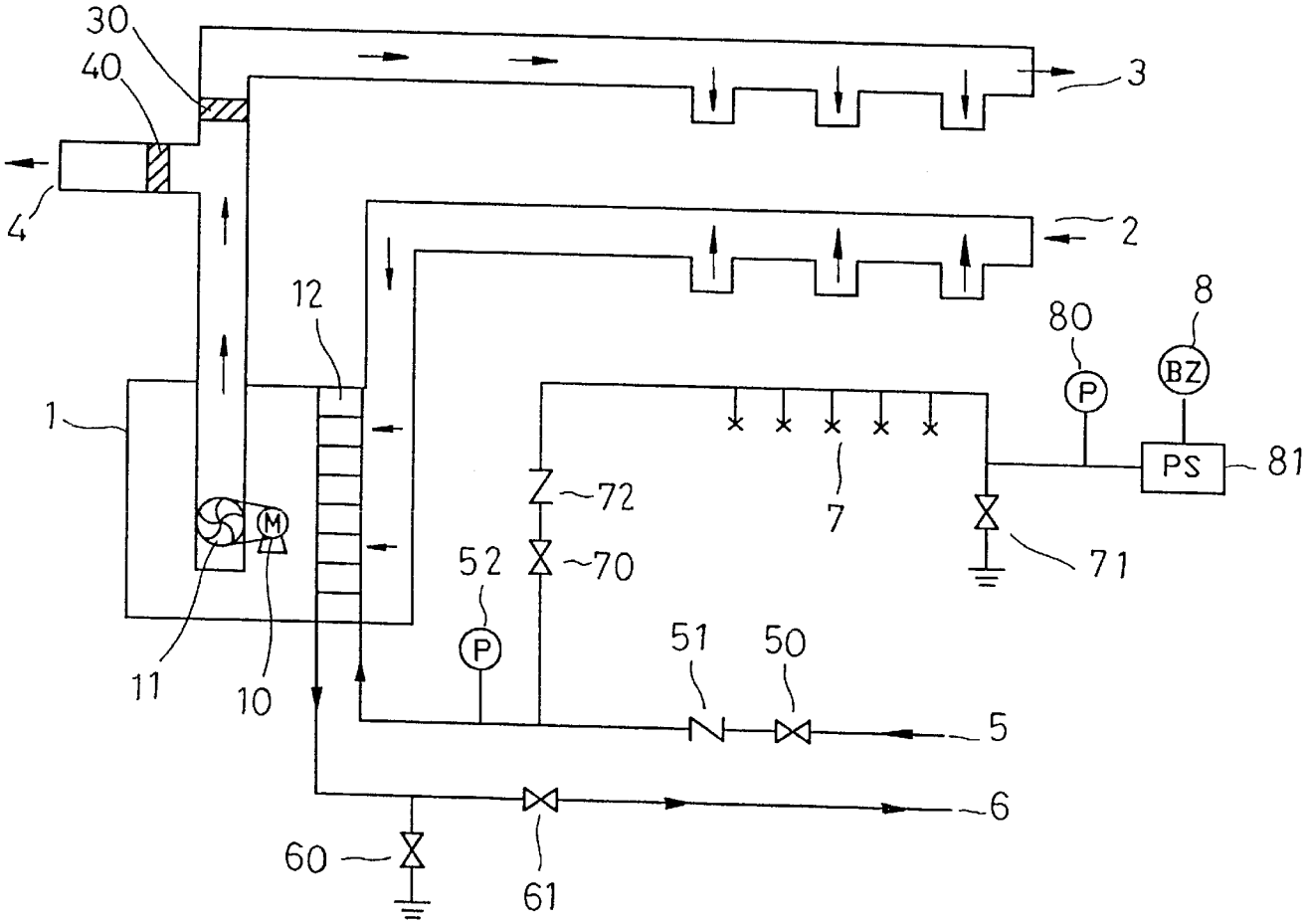
FIG. 1 is a diagram of arrangement of an air conditioner having functions of fire preventing, smoke exhausting and water spraying in the present invention.

A first embodiment of an air conditioner having functions of fire preventing, smoke exhausting and water spraying in the present invention, as shown in FIG. 1, includes an air conditioning box 1, a wind inlet 2, a wind outlet 3, a smoke outlet 4, a water inlet 5, a water outlet 6, a water spraying nozzle 7 and an alarm 8 as main components combined together.

The air conditioning box 1 has a motor 10 installed at an inner side. The motor 10 is connected to a fan 11 and has the other end connected to a condenser 12. The wind inlet 2 is connected to the condenser 12 of the air conditioning box 1, while the wind outlet 3 is connected to the fan 11, having a wind-releasing gate 30. The smoke outlet 4 is connected to the fan 11 of the air conditioning box 1, having a smoke-exhausting gate 40. The water inlet 5 is connected to the condenser 12, having a water-stopping valve 50, a back-pressure valve 51 and a pressure gauge 52, while the water outlet 6 is connected to the condenser 12, having a water-exhausting valve 60 and a water-stopping valve 61. The water-spraying nozzle 7 is connected between the backpressure valve 51 and the pressure gauge 52 and provided with two water-stopping valves 70, 72 and a back-pressure valve 71 at opposite sides. The alarm 8 is connected between the water-spraying nozzle 7 and the water-stopping valve 71 and provided with a pressure gauge 80 and a pressure switch 81.

Figure 2:
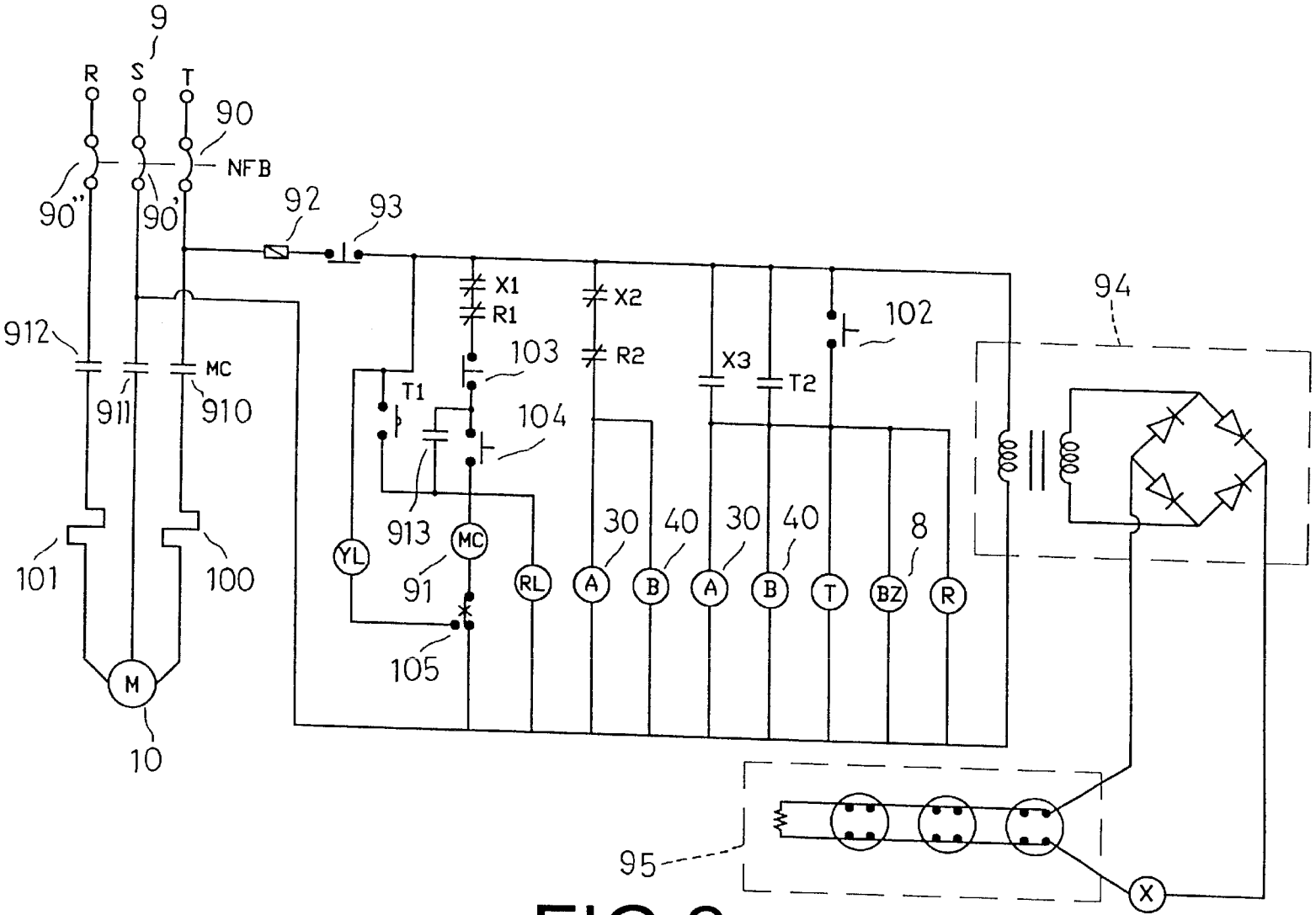
FIG. 2 is a circuit diagram of the air conditioner having functions of fire preventing, smoke exhausting and water spraying in the present invention.

Next, FIG. 2, shows a circuit of the air conditioner in the invention, having a power terminal 9 connected to three no-fuse switches 90, 90' and 90", which are connected respectively to normally-open contacts 910, 911, 912 of a magnet control switch 91 and then to the motor 10. Then motor overload protective circuits 100, 101 are provided between the motor 10 and the normally-open contacts 910, 912,and a fuse 92 is provided between the no-fuse switch 90 and the normally-open contact 910. The fuse 92 is then connected to a reset switch 93, which is connected to a yellow lamp YL, a timing contact T1 of the timer T, normally-closed contacts X1, X2 of the timer T1 the magnet control switch 102, and the transforming and rectifying circuit 94. The normally-closed contact X1 is connected in series to a normally-closed contact R1 of a relay R and the motor switch 103. The motor switch 103 is connected in parallel to a normally-open contact 913 of the magnet control switch 91 and a motor switch 104. The other end of the normally-open contact 913 and the motor switch 104 are connected to another end of the timing switch T1, the magnet control switch 91 and a red lamp RL, while the magnet control switch 91 is connected to the motor overload protective contact 105, which is connected to the other end of the yellow lamp YL. The normally-closed contact X2 is connected in series to the normally-closed contact R2, which is connected in parallel to the wind-releasing gate 30 and a smoke-exhausting gate 40. The normally-open contacts X3, T2 and the motor compulsory switch 102 are connected in parallel to the wind-releasing gate 30, the timer T, the alarm 8 and the relay R. The motor overload protective contact 105, the red lamp RL, the wind-releasing gate 30, the smoke-exhausting gate 40, the timer T, the alarm 8 and the other end of the relay R are connected between the no-fuse switch 90' and the normally-open contact 911, and then further connected to the transforming and rectifying circuit 94 to form a parallel circuit. The other end of the transforming and rectifying circuit 94 is connected to the relay X and a sensor 95.

In using the air conditioner in the invention, referring to FIGS.1 and 2, just install the sensor 95 at the wind inlet 2, When the air conditioner operates normally under no firs, the motor switch 104 is made to short-circuit to let it closed so that the magnet control switch 91 is magnetized to control the normally-open contacts 910, 911, 913 closed, At the same time the power terminal 9 supplies power to the motor 10, with the current flowing through the fuse 92, the reset switch 93, the normally-closed contacts X1, X2, the motor switch 103, 104 and the red lamp RL. Then the red lamp RL lights up, and another current flows through the normally-open contacts X2, R2 to the wind releasing gate 30 and to the smoke-exhausting gate 40. Then the wind-releasing gate 30 is opened, but the smoke-exhausting gate 40 is closed, forcing the normally-closed contacts X1, X2, R1, R2 of the relays X, R all close. Then one more current flows through the normally-open contacts X3, T2, the motor switch 102 and the transforming and rectifying circuit 94. At that time, the normally-open contacts X3, T2 and the motor compulsory switch 102 are all cut off, so the current flows through the transforming and rectifying circuit 94 to become a transformed and rectifies current and goes to the relay X, the sensor 95 and the whole circuit for maintaining a normal operation. In other words, the circuit voltage of the sensor 95 is 24 V DC, and if the motor 10 operates normally, the fan 11 is rotated. At this time ice water flows through the water inlet 5 in the condenser 12 by control of the stopping valve 50, the backpressure valve 51, with the pressure gauge 52 showing its pressure. Then water flows out of the other end of the condenser 12 and through the water outlet 6 by control of the outlet valve 60 and the stopping valve 61. So when the motor 10 rotates the fan 11, the wind blows through the wind inlet 2 and is sucked in the air conditioning box and sent out of the air conditioning box 1 by the condenser 12, and then the cool wind flows through the wind-releasing gate 30 and the wind outlet 3, performing air conditioning.

If the motor switch 103 is started, electricity is cut off, and the motor 10 is stopped in operation. Even if current flows through the fuse 92, the reset switch 93, the yellow lamp YL and to the motor overload protective contact 105 in case of the motor 10 being in operation, the yellow lamp YL is lit up and the red lamp is not lit up, the motor magnet control switch 91 is not magnetized so that the motor 10 may be stopped in case of overload. But if a disorder is repaired, the yellow lamp YL may not be lit up, and the sensor 95 may maintain normal operation whether the motor 10 operates or not.

In case smoke or high temperature is produced in a room by a fire, the sensor may sense out dense smoke or high temperature to magnetize the relay X, which cuts off the normally-closed contacts X1, X2. Then the motor 10 may be stopped, and current flows through the normally-open contacts X3, T2, the motor switch 102 and then to the transforming and rectifying circuit 94. At this time, the normally-open contact X3 is short-circuited, or ON, permitting current flow to the wind-releasing gate 30 and the smoke-exhausting gate 40. Then the wind-releasing gate 30 is closed, but the smoke-exhausting gate 40 is opened to activate the alarm 8, which then gives out an alarm, and the timer T is magnetized to short-circuit the normally-open contact T2, and counts time. When the preset period of time is up, the contact T1 becomes short-circuited to let current flow through to the motor magnet control switch 91 to make the normally-open contacts 910, 911 short-circuited so that the motor 10 at once begins to operate. Then the motor 10 rotates the fan 11 to suck dense smoke into the wind inlet 2 and in the air conditioning box 1. Then the water stopping valve 50 and the backpressure valve 51 with pressure indication by the pressure gauge 52 controls ice water to flow through the water stopping valve 70, the back-pressure valve 72 to the spraying nozzle 7, which then sprays out ice water to extinguish the firs and high temperature. Then the condenser 12 receives no ice water, and remaining ice water is exhausted out of the outlet valve 60 and the stop valve 61. After dense smoke is sucked in the air conditioning box 1, it is exhausted out of the air conditioning box 1 through the condenser 12 and through the smoke-exhausting gate 40 and smoke outlet 4. Meanwhile, the pressure gauge 80 and the pressure switch 81 can control the alarm sound of the alarm 8, and if the reset switch 93 is pressed to cut off the power, then all operations are stopped.

But if the sensor 95 should not operate in case of a fire, the motor switch 102 can be manually pressed to become short-circuited to let current flow through the wind releasing gate 30, the smoke-exhausting gate 40, the timer T, the alarm 8, and the relay R to start the motor 10. Then the timer T counts time, the alarm 8 gives out warning sound, and the relay R is magnetized to cut off the normally-closed contacts R1, R2, but the normally-open contact X3 becomes short-circuited to let current flow through so that the wind-releasing gate 30 may shut, but the smoke-exhausting gate 40 may open. Thus smoke exhausting, water spraying and alarm warning can be effected by manual operation in case of an emergency that the sensor 95 does not work.

When a fire is already put out, with temperature lowered and smoke exhausted, the water spraying nozzle 7 and the alarm 8 may be turned off to let the air conditioner recover its normal operation.

The invention has the following advantages, as can be understood from the aforesaid description.

1. It has a function of air preventing and water spraying in addition to air conditioning, elevating public integrity.

2. It can save expenditure for separately accommodate an air conditioner, a fire preventing, smoke exhausting and water-spraying device, and effectively making use of a room space.

3. It is easy and convenient to use, maintain, and repair.

4. If a plurality of air conditioners is used, every air conditioner can be provided with a control circuit connected to a control center.

While the preferred embodiment has been described above, it will be recognized and understood that various modifications may be made therein and the appended claims are intended to cover all such modifications that may fall within the spirit and scope of the invention.

I claim:

1. An air conditioner having functions of fire-preventing, smoke exhausting and water spraying, said air conditioner comprising:

an air conditioning box having a motor fixed in an inner side, a fan connected to said motor, and a condenser fixed in another inner side;

a wind inlet connected to said condenser in said air conditioning box;

a wind outlet connected to said fan in said air conditioning box;

a smoke outlet connected to said fan in said air conditioning box, a smoke-exhausting gate provided at said smoke outlet;

a water inlet connected with said condenser in said air conditioning box, a stop valve, a backpressure valve and a pressure gauge provided at said water inlet;

a water outlet connected with said condenser of said air conditioning box, an exhausting valve and a stop valve provided at said water outlet;

a water-spraying nozzle connected between said backpressure valve of said water inlet and said pressure gauge, a stop valve and a backpressure valve provided at said water spraying nozzle;

an alarm provided between said water spraying nozzle and said stop valve of said nozzle; and, a sensor fixed at a proper location in said air conditioner, said sensor capable to sense smoke or temperature in a room where said air conditioner is positioned so as to control said wind-releasing gate, said smoke-exhausting gate, said water-spraying nozzle, and said alarm in their operations, dense smoke sucked quickly in said air conditioning box and exhausted out of said smoke exhausting gate and smoke outlet in case said sensor senses dense smoke or high temperature, said water-spraying nozzle and said alarm activated to operate at the same time with said sensor, carrying out functions of air conditioning, fire preventing, smoke exhausting and water spraying to elevate public safety.

2. An air conditioner with functions of fire preventing, smoke exhausting and water spraying comprising a plurality of no-fuse switches, said no-fuse switches connected respectively to normally-open contacts connected to a motor, a motor overload protective circuit provided between said normally-open contacts and said motor, a fuse provided between one of said no-fuse switches and one of said normally-open contacts, a reset switch connected to said fuse, said reset switch connected in parallel with a yellow lamp, a timer contact, a normally-closed contact, a normally-open contact, a motor compulsory switch and a transforming and rectifying circuit, said normally-closed contact having another end connected in series to another normally-closed contact and a motor switch, said motor switch having another end connected in parallel to another normally-open contact and another motor switch, said normally-open contact and said motor switch having another end connected to one end of a timer and a magnet control switch, a red lamp, said magnet control switch having another end connected to a motor overload protective contact, said motor overload protective contact also connected to another end of said yellow lamp, another normally-closed contact connected in series to other normally-closed contacts, said other normally-closed contacts having other ends connected respectively to a wind-releasing gate and a smoke-exhausting, said normally-open contact and said motor compulsory switch connected in parallel to said wind-releasing gate, said smoke-exhausting gate, a timer, an alarm and one end of a relay, and then connected to a transforming and rectifying circuit to form a kind of circuit, said transforming and rectifying circuit having another end connected to another relay and a sensor.

* * * * *